US006273305B1

(12) United States Patent
Fioravanti et al.

(10) Patent No.: US 6,273,305 B1
(45) Date of Patent: Aug. 14, 2001

(54) VALVES FOR PACKAGING CONTAINERS

(75) Inventors: Alex Fioravanti; Christopher Paul Ramsey, both of Oxfordshire (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/486,090

(22) PCT Filed: Jul. 27, 1998

(86) PCT No.: PCT/GB98/02230

§ 371 Date: Feb. 22, 2000

§ 102(e) Date: Feb. 22, 2000

(87) PCT Pub. No.: WO99/10247

PCT Pub. Date: Mar. 4, 1999

(30) Foreign Application Priority Data

Aug. 21, 1997 (GB) ..... 9717595

(51) Int. Cl.[7] ..... B65D 25/40; B65D 5/72
(52) U.S. Cl. ..... 222/494
(58) Field of Search ..... 222/494, 490, 222/212, 213; 137/845

(56) References Cited

U.S. PATENT DOCUMENTS 5,213,236 * 5/1993 Brown et al. ..... 222/185
5,339,995 * 8/1994 Brown et al. ..... 222/185
5,377,877 * 1/1995 Brown et al. ..... 222/105
5,409,144 * 4/1995 Brown ..... 222/185
5,439,143 * 8/1995 Brown et al. ..... 222/185
5,839,614 * 11/1998 Brown ..... 222/185

* cited by examiner

*Primary Examiner*—Kevin Shaver
*Assistant Examiner*—Patrick Buechner
(74) *Attorney, Agent, or Firm*—Diller, Ramik & Wight

(57) ABSTRACT

A self-closing valve for a packaging container, especially a thin-walled plastics bottle, has an outwardly concave valve head (22) joined to an outer margin (20) by a flexible connecting wall (24). The connecting wall has a frustoconical outer portion (56) and a cylindrical inner portion (57) joined together at an elbow (58). The inner portion (50) is joined to the valve head at a thin, inturned flange (60). The outer portion (56) of the connecting wall is frustoconical and moves between downwardly inclined and upwardly inclined positions as the valve advances to its dispensing position. The outer portion (56) accordingly imparts a bistable operating characteristic to the valve. The elbow (58) of the connecting wall (24) acts as a spring to retract the valve head (22) quickly after dispensing. The flange (60) acts as a living hinge, with substantially no flexural stiffness, so that subsequent deformation of the valve head (22) to allow venting is not resisted.

13 Claims, 6 Drawing Sheets

VALVES FOR PACKAGING CONTAINERS

BACKGROUND OF THE INVENTION

This invention relates to self-closing valves for packaging containers, that is to say, valves which open in response to an elevated pressure of the liquid product in a packaging container, and which close again automatically and in a self-sealing manner when the pressure has subsequently been reduced to below ambient pressure.

Self-closing valves are well known in the patent literature, and examples of them are disclosed in published patent specifications EP 0545678, EP 0395380, FR 996998, U.S. Pat. No. 2,758,755, U.S. Pat. No. 2,175,052 and WO 97/05055 amongst many others. Self-closing valves have been proposed for use with a wide variety of liquid foods e.g. ketchups, and household products e.g. washing-up liquids.

The requirements of a self-closing valve to dispense product in a controlled manner when required and to automatically reseal after dispensing tend to conflict with one another insofar as the configuration of the valve is concerned. Amongst the other requirements which may impose further restraints on the valve design are the need for the valve head to adopt an advanced position for the dispensing operation, and for the valve to be capable of being readily sealed, against inadvertent operation or dribbling, by a travel head with which it is engaged up to the point of use. In addition, for cleanliness of operation it may be preferred for the valve head at all times to stand proud of the closure in which the valve is mounted.

A further desirable characteristic of a self-closing valve is that it is capable of venting the container headspace in response to small negative pressures which are generated there after dispensing. This is of particular concern where the containers are plastics squeeze bottles which for economy have a reduced wall thickness, e.g. 0.4 mm, and a correspondingly reduced ability to resile when they are allowed to relax. Without the ability of the valve to vent, such a container may be subject to unsightly inward panelling and crumpling of its body wall. Satisfactory venting and reclosure of a self-closing valve in response to negative pressures of 1 kPa or less is therefore desirable.

In attempting to meet the various requirements imposed upon them known self-closing valves have been made from a substance having advanced physical properties, in particular of flexibility and resilience. Liquid silicon such as is marketed by Bayer under the trade name Silopren has been particularly preferred for this purpose, although thermoplastic elastomers have also been contemplated.

These materials are expensive in comparison with the thermoplastic resin materials usually used for packaging, and for cost savings it is therefore desirable, as a further objective, to minimise the material weight of the valve.

SUMMARY OF THE INVENTION

The present invention seeks to provide a self-closing valve which satisfies the above requirements to at least a substantial degree. In accordance with the invention from one aspect thereof a self-closing valve for a packaging container comprises (a) a marginal region by which the valve may be peripherally secured to a housing so as to close an opening in the same, (b) a valve head having an openable dispensing aperture and movable axially in relation to the marginal region between an advanced, dispensing position in which the aperture is open and product may be dispensed under pressure and a retracted, inoperative position in which the aperture is closed and the valve head forms a seal and (c) a connecting wall which is imperforate and flexible and comprises first and second portions serially arranged between the marginal region and the valve head and joined together at a V-form elbow, the first portion extending inwardly from the marginal region to the elbow, the second portion extending generally axially from the elbow to peripheral attachment with the valve head, and the connecting wall being of increased wall thickness at the elbow whereby during operation of the valve the elbow may keep its identity and act resiliently as a spring for returning the valve head to its retracted position.

The first portion of the connecting wall may be substantially frustoconical when the valve head is in each of its retracted and advanced positions, extending inwardly and downwardly away from the valve head in its retracted position, and extending inwardly and upwardly towards the valve head in its advanced position. In this way the connecting wall may be arranged to give a bistable operating characteristic to the valve at a positive pressure of typically 3 to 5 kPa.

As an alternative to providing bistable operation for the valve, the first portion of the connecting wall may be arranged to move from a substantially frustoconical, inwardly and downwardly extending unstressed position to a substantially plane, metastable position as the valve head moves between its retracted and advanced positions. In this way it may be arranged to provide substantial assistance to the elbow to return the valve head resiliently to its retracted position. DE 196 13 130 discloses a self-closing valve in accordance with the precharacterising part of claim 1. The valve has a thickened portion of its connecting wall designed for variously acting as a passive abutment with the closure structure and with a further part of the connecting wall. In particular, the connecting wall of the valve of DE 196 13 130 has no V-form elbow capable of acting as a spring to return the valve head to its retracted position.

In accordance with a second aspect thereof a self-closing valve for a packaging container comprises (a) a marginal region by which the valve may be peripherally secured to a housing so as to close an opening in the same, (b) a valve head having a dispensing aperture formed in a central part thereof and openable to allow product to be dispensed under pressure, the valve head being self-closable to form a seal when the product pressure subsequently abates and (c). a connecting wall which is imperforate and flexible and connects the marginal region with the valve head, characterised in that the connecting wall has a substantially cylindrical first part and an inturned, substantially radially extending second part by which the first part is attached to the valve head periphery, the thickness of the valve head reducing from the valve head periphery inwardly towards the dispensing aperture, and the second part of the connecting wall having a thickness which is at most one third of the thickness of the valve head periphery and such that during operation of the valve the second part may act as a living hinge, with substantially no flexural stiffness.

Preferably, the at-rest position of the valve in use is the same as the position in which it is manufactured.

In conjunction with the substantial lack of flexural stiffness of the second part of the connecting wall, this feature assists venting.

In order that the invention may be more fully understood, self-closing valves embodying the invention will now be described, by way of example, with reference to the accompanying drawings. Of the drawings:

DESCRIPTION OF THE PREFERRED EMBODIMENTS

Figure 1:
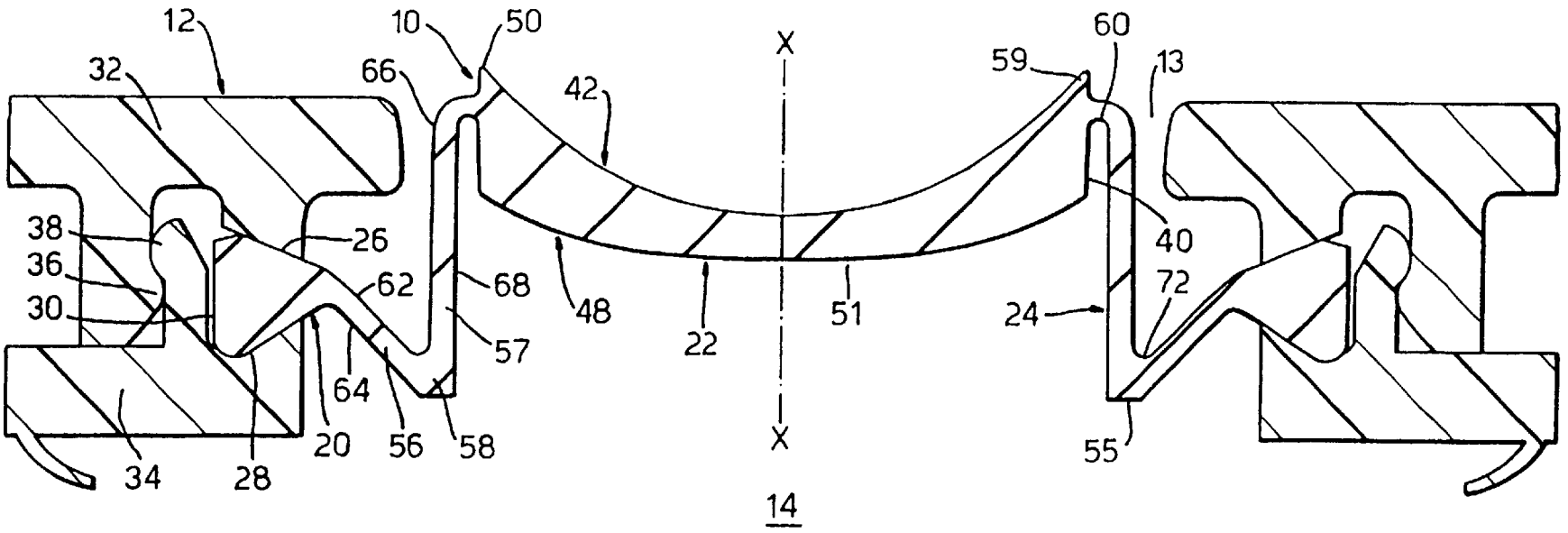
FIG. 1 diagrammatically shows a first valve and the adjacent part of the housing in which it is mounted, the valve being shown in central cross-section and in its retracted or "at rest" position.
Figure 2A:
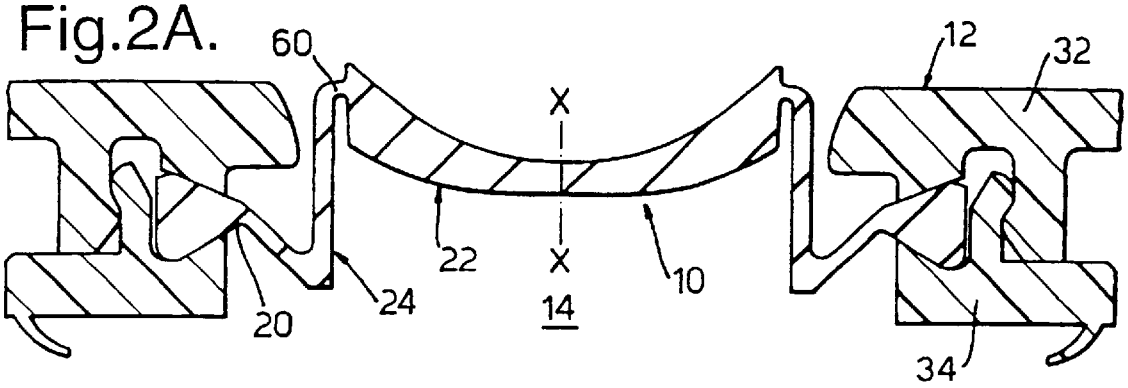
FIGS. 2A through 2G are views identical to FIG. 1 but to a smaller scale, showing the first valve at several stages during its operation to dispense product and subsequently return to its retracted position.
Figure 2B:
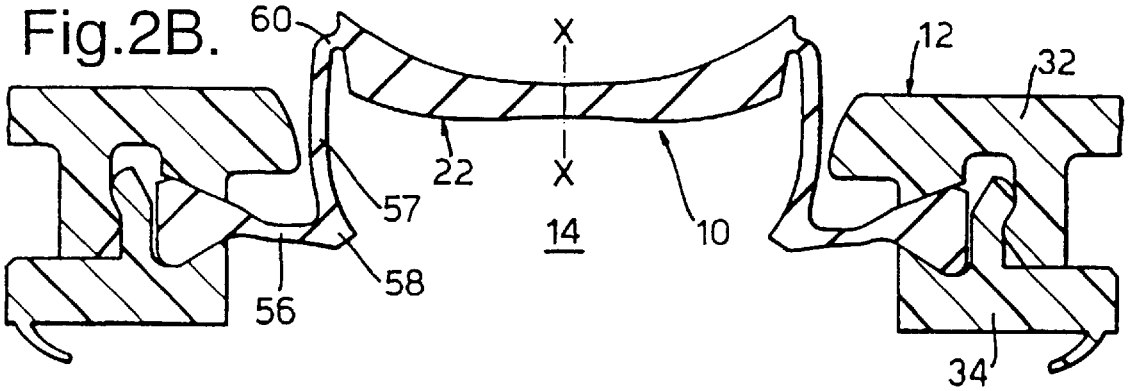
Figure 2C:
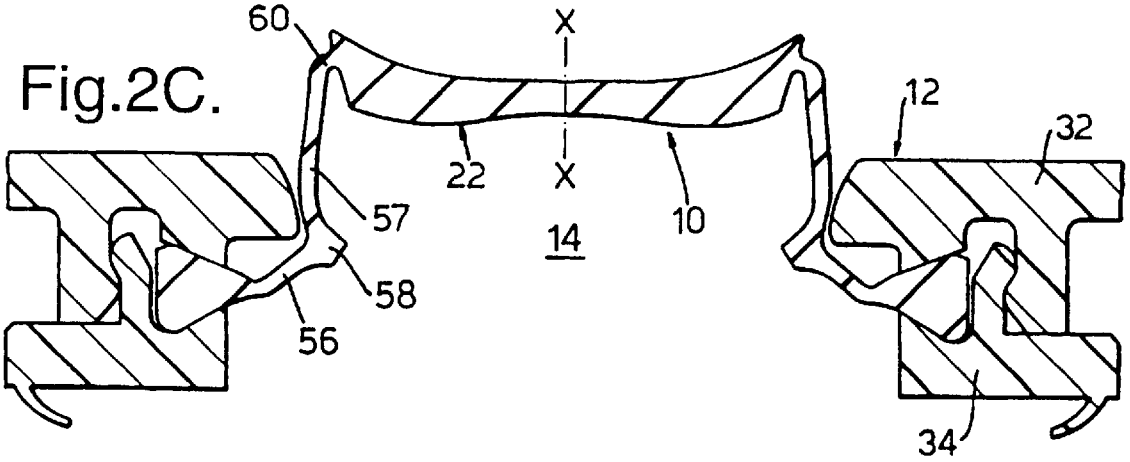
Figure 2D:
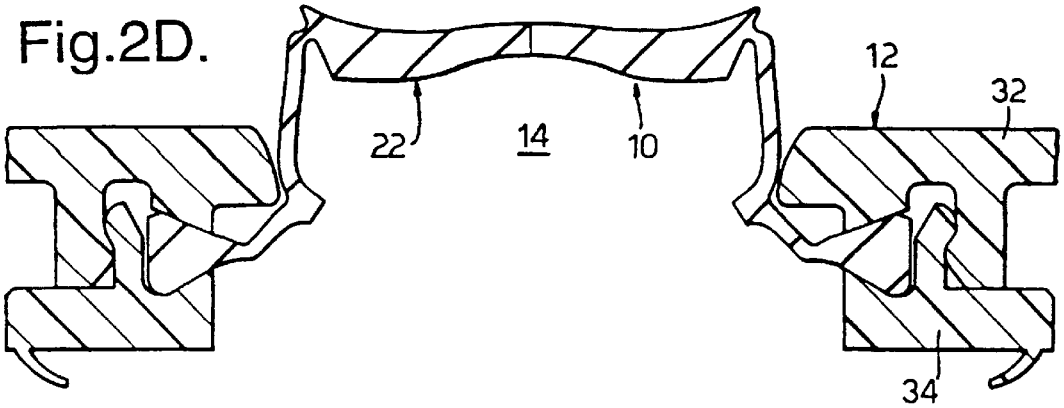
Figure 2E:
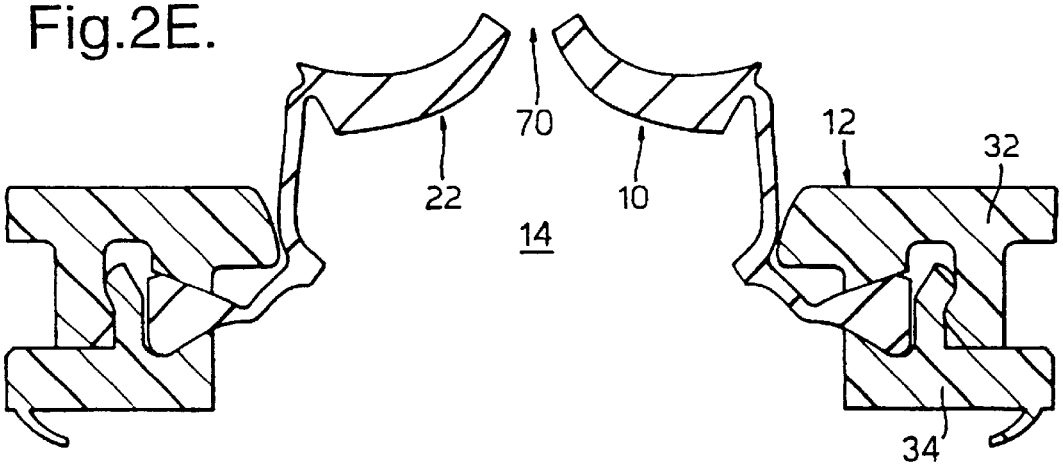
Figure 2F:
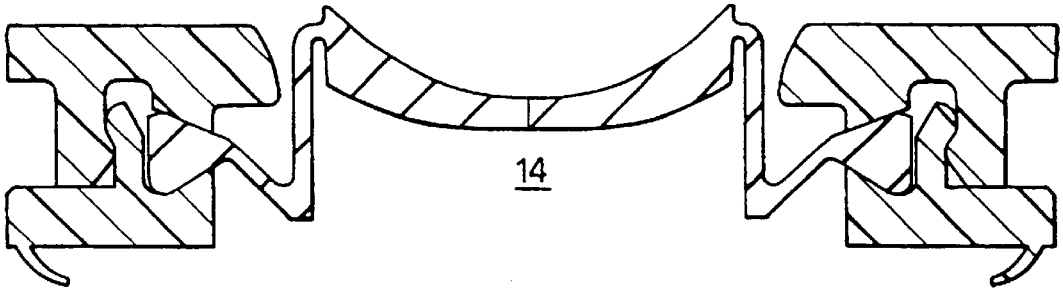
Figure 2G:
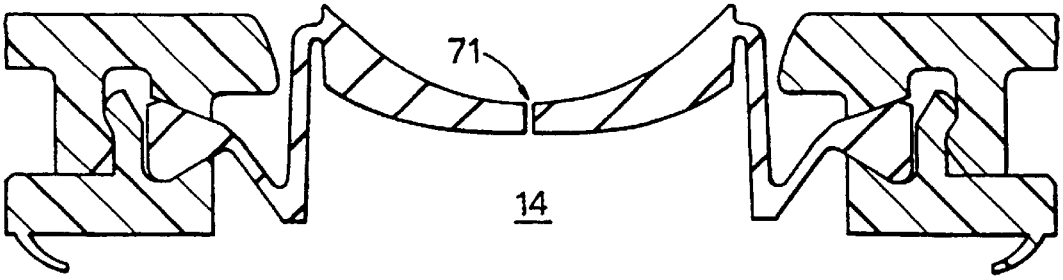
Figure 3:
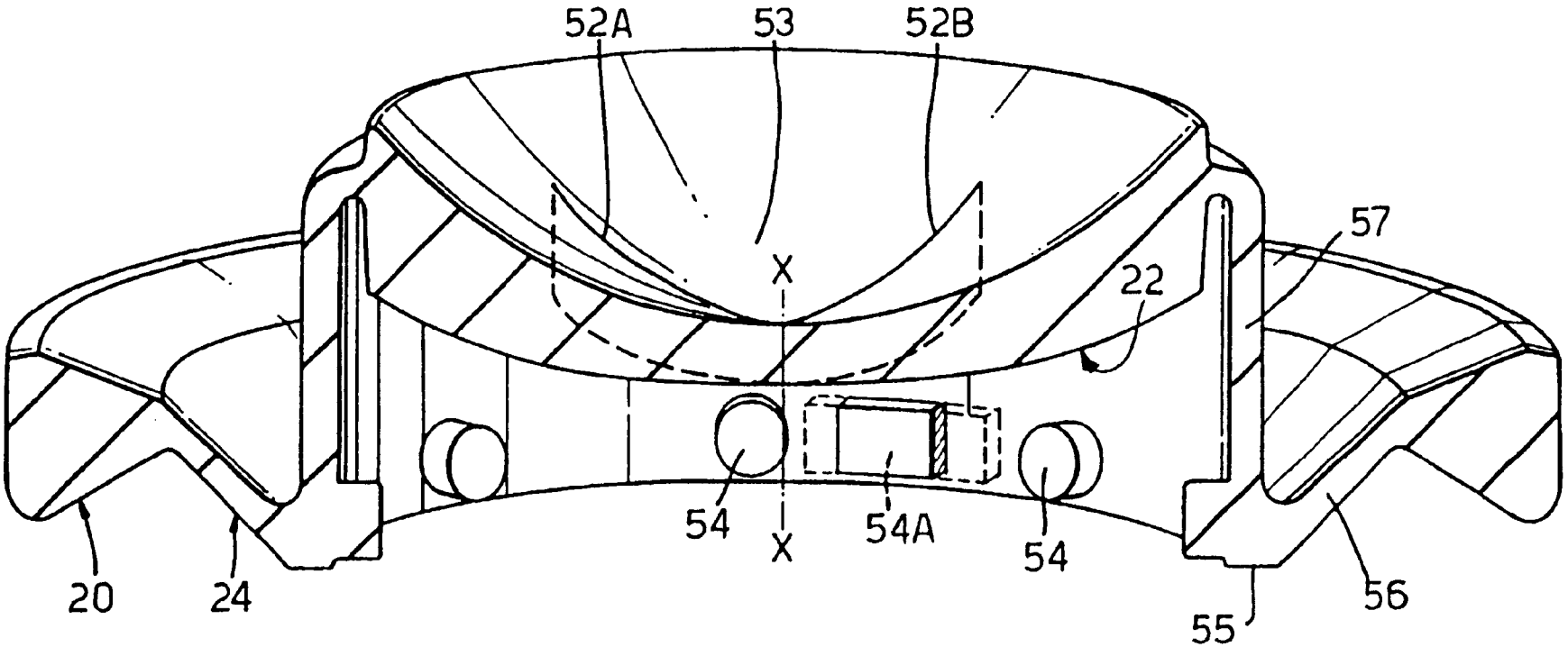
FIG. 3 shows the first valve in perspective view and as seen on a diametral section to a larger scale than FIGS. 1 and 2.

Referring firstly to FIGS. 1 to 3 of the drawings, a self-closing valve 10 is mounted in a housing 12, only part of which is shown. The housing has an opening 13 in which the valve is located. The housing forms part of a plastics closure which is itself mounted on a plastics container of a liquid food or other product. The closure may be a snap cap but more usually it will be a screw cap.

The container (not shown) is squeezable to expel product through the valve, and it is resilient so as after a dispensing operation to generate a negative pressure within the container headspace 14 and so cause the valve 10 to return to the as-moulded, retracted condition shown in FIG. 1. The behaviour of the valve during its dispensing and retracting movements will be described later in detail.

The valve 10 is a unitary moulding of a suitable flexible and resilient material, Liquid Silicon Rubber sold by Bayer under the trade name Silopren being preferred. It has three parts, namely a thickened mounting ring 20 which forms a continuous marginal region around the valve, a valve head 22 capable of movement axially of and within the mounting ring between the retracted position shown in FIG. 1 and the advanced position at which dispensing takes place—See FIGS. 2D, 2E—and an imperforate connecting wall 24 which connects the mounting cup with the valve head.

The mounting ring 20 is generally triangular in cross-section, having a cylindrical outer face 30, and inclined upper and lower faces 26 and 28 which converge inwardly of the valve towards the attachment of the connecting wall 24.

For engaging and holding the valve 10 the housing 12 has upper and lower parts 32 and 34 which are snap-engaged together by resilient engagement of complementary snap formations 36 and 38. Opposed inclined surfaces of the parts engage the faces 26, 28 of the mounting ring to hold it securely in position in a sealing manner.

In the embodiment shown, the lower part 34 of the housing forms an integral part of a screw closure onto which the upper part 32 is snap-engaged. By suitable modification, however, the upper part may be incorporated into the closure, and the lower part be provided as a separate component which is fitted to it.

The valve head 22 is concave to the exterior of the closure and is of progressively reducing thickness in the direction of its centre line XX from the cylindrical face 40 which forms its outer periphery. Its exterior face 42 is arcuate, and its interior face 48 is arcuate except at a central flat 51. The outer cylindrical face 40 and the exterior face 42 converge to a sharply defined circular free edge 50 which forms the topmost point of the valve head as shown.

From FIG. 3 it will be understood that the valve head 22 is formed with two identical straight cuts 52A, 52B, which intersect at their midpoints on the centreline XX. The cuts are orthogonal to one another, and each cut extends through the thickness of the valve head. In combination the cuts therefore form four individually movable triangular tongues 53 attached to the valve head along the sides of a square and having their apices coincident on the centreline.

One of the tongues is shown in full in FIG. 3. Also visible in FIG. 3 is a ring formed of eight regularly spaced bosses 54 which project inwardly from the connecting wall 24 adjacent its bottom edge 55. The bosses prevent nesting of the valves together prior to their automatic assembly into housings 12. For clarity, they are omitted from the other drawings.

The connecting wall 24 has outer and inner parts 56, 57 connected at an elbow 58. When the valve is in its as-moulded, retracted position, i.e. as shown in FIG. 1, the outer part is frustoconical, so as to extend inwardly and downwardly between the mounting ring 20 and the elbow. The inner part 57 of the connecting wall is cylindrical, extending axially between the elbow and a radially extending, short and thin, inturned flange 60 at which it is connected to the cylindrical outside face 40 of the valve head 22. The height of the side face 40 of the valve head is 1.87 mm, and the thickness of the flange is 0.3 mm; thus, the valve head is more than six times the thickness of the flange at the junction between them.

The flange 60 is attached to the side face 40 of the valve head at a spacing of 0.46 mm below the top free edge 50 of the valve head. The part of the valve head lying above the flange and including the free edge 50 accordingly defines an upwardly tapering and relatively compliant lip 59 which is capable of promoting drip-free product flow and of forming a product-tight seal against a flat surface of a travel cap (not shown) if required. For this purpose, and as can be seen from the drawings, the lip projects above the surrounding upper surface of the housing at all times during operation of the valve.

The outer part 56 of the connecting wall 24 is inclined at an angle of 45° to the centreline XX of the valve, and therefore to the inner part 57. The substantially V-shaped notch which is formed between the two parts is denoted by the reference numeral 72.

The material thickness of the outer wall part 56 is uniform, at 0.31 mm. With the exception of the connecting flange 60 the inner wall part 57 likewise has a uniform thickness, its thickness being 0.40 mm, that is, somewhat greater than that of the outer wall part and of the flange 60.

The outer wall part 56 has upper and lower surfaces 62, 64 respectively, the inner wall part 57 having outer and inner surfaces 66, 68. The bottom edge 55 of the connecting wall 24 is a plane annular face formed where the inner wall part intersects the lower surface 64 of the outer wall part at the base of the elbow 58. The material thickness at the elbow is therefore substantial, being 0.94 mm as measured from the bottom inner corner of the elbow to the acute-angled notch 72 at which the mutually facing surfaces 62, 66 intersect one another. The elbow accordingly has a substantial rigidity against forces which tend to open it by separating the surfaces 62, 66 in its location; in particular it is capable of acting as a spring, as will later be described.

FIG. 3 illustrates a modification of the valve, in which the ring of spaced bosses 54 previously described is replaced by an inwardly projecting continuous bead 54A of rectangular cross-section corresponding in location and cross-sectional dimensions (radial depth and axial height) to those of the ring of bosses. In addition to preventing nesting of adjacent valves prior to their assembly in housings 12, the bead increases the stiffness of the connecting wall 24 at the elbow 58, and assists in the valve moulding operation by enabling the valve to be held securely on the mould core until it can be stripped, under full control, from the mould core.

Reference is now made to the various parts of FIG. 2 which show the valve in successive stages of its operation to dispense product and subsequently to retract with venting of air into the container interior.

FIG. 2A is a reproduction of FIG. 1 and shows the as-moulded, retracted position of the valve which occurs when little or no pressure differential exists across the wall of the container.

When it is required to dispense product the container is squeezed by the user to generate a substantial overpressure of, typically, 3 to 5 kPa within the container. In response to this pressure the valve head rises, accompanied by inversion of the outer part 56 of the connecting wall 24 from its original "down" (i.e. downwardly and inwardly extending) position to the "up" (i.e. upwardly and inwardly extending) position which exists during product dispensing (See FIG. 2E).

In each of its "down" and "up" limiting positions the outer wall part 56 is generally frustoconical. In its movement between these positions it passes through the metastable intermediate condition shown in FIG. 2B, in which it has maximum internal stress and stored energy. It therefore imparts a desired bistable operating characteristic at a positive pressure to the valve. In FIG. 2C the outer wall part is approaching its "up" position; and in FIGS. 2D and 2E it has reached its "up" position.

The movement of the outer wall part 56 is largely passive, and caused by the generally axial forces transmitted to it by the inner wall part 57. A minor part of the motive force, however, will be generated by the product pressure on the outer wall part itself.

As will be understood from a comparison of FIGS. 2A to 2E, the movement of the outer wall part 56 is accompanied by hinging movement of the outer wall part on the mounting ring 20 at the attachment between them, together with opening of the elbow 58 to an obtuse angle of approximately 120° at its notch 72. Some distortion of the wall parts 56, 57 individually will also occur, both in response to the product pressure and in order to accommodate the opening of the elbow and its translational inward movements which accompany the inversion of the outer wall part. However, at all times the outer wall part remains substantially frustoconical or plane, and the inner wall part remains substantially cylindrical.

A comparison of FIGS. 2A to 2E clearly shows the behaviour of the valve head 22 during a movement from its retracted position in FIG. 2A to its advanced dispensing portion (FIG. 2E). It will be seen that in response to product pressure the head becomes progressively less concave and flattened as the tongues 53 flex and hinge in an upward direction about their attachment to the remainder of the valve head. At about the time that the advanced position of the head is reached (FIG. 2D) and typically at a pressure of 5 to 8 kPa, the tongues pass a dead-centre position at which they are approximately coplanar; thereafter, with further flexing and hinging movement in the upward direction they separate from one another to leave an aperture generally in the form of a cross and through which product may be dispensed as indicated by the arrow 70.

After dispensing has occurred the user relaxes his grip on the associated container, and the pressure in the container headspace 14 falls and eventually becomes negative as the container resiles. In response to the falling pressure the valve head 22 is moved quickly back to its retracted position by the resilience of the elbow 58 together with a minor contribution from relaxation of longitudinal stress in the component parts of the connecting wall 24; at the same time the head returns to its original position by virtue of the resilience provided by its own relatively thickwalled construction. FIG. 2F shows this situation; the valve has the same general appearance as in FIGS. 1, 2A and 3, but at this time the pressure in the container headspace is becoming negative and venting is required to allow the container fully to resile. This is accomplished by continued downward flexing and hinging movement of the tongues 53 in relation to the valve head 22 as a whole, until they can separate sufficiently to allow air to relieve the pressure differential. In this way residual panelling or crumpling of the container can be avoided. In FIG. 2G the venting aperture is shown and indicated by the reference 71. After venting the tongues return to their position shown in FIG. 2F.

The spring action of the elbow 58 assists the movement of the valve head back to its retracted position after dispensing. This is of particular value where the associated container is of thin-walled construction (e.g. less than 0.4 mm or less in thickness) and has a corresponding limited resilience. The elbow ensures a quick returning action of the valve and provides the valve with a positive "feel" for the user.

As previously mentioned, the flange 60 by which the connecting wall 24 is attached to the valve head 22 is thin, having a wall thickness of only 0.3 mm. It will be seen from FIGS. 2A to 2E that as the valve moves towards its dispensing condition (FIG. 2E) the outer face 40 of the valve head and the part of the connecting wall 24 which lies opposite are required to separate from one another. Because it has little or no flexural stiffness, the flange presents little or no resistance to this separating movement. It acts essentially as a living hinge attachment by which translational movements of the valve head and the connecting wall may be transmitted from one to the other. Moreover, because the retracted position of the valve (shown in FIGS. 2A, 2F) is also the as-moulded position in which it is manufactured, the flange 60 is substantially without stress when the valve is in that position. Because of this lack of stress any flexural stiffness which the flange does possess will not create torsional forces in the valve head in the sense to resist the distortion of the valve head which is required for it to vent, i.e. as depicted in FIG. 2G. Applicants believe that the thickness of the flange 60 should be at most one third of the thickness of the valve head periphery.

Figure 4A:
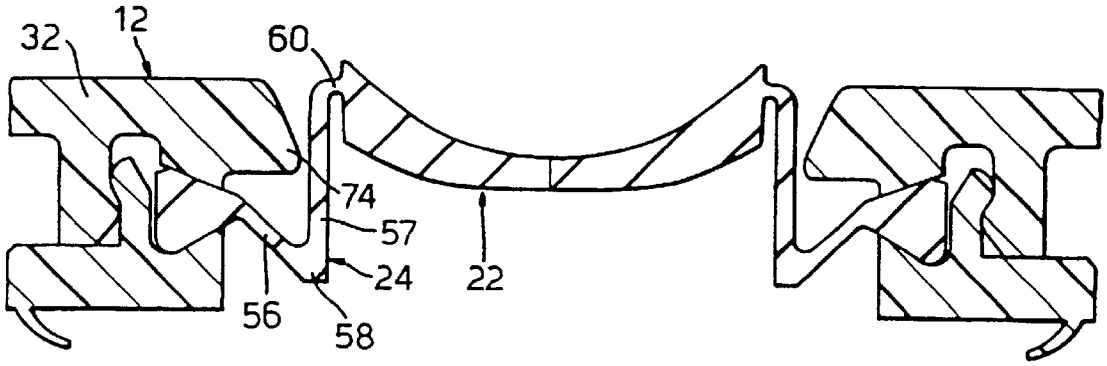
FIGS. 4A through 4C show a second valve in accordance with the invention, in views similar to some of those of FIG. 2.
Figure 4B:
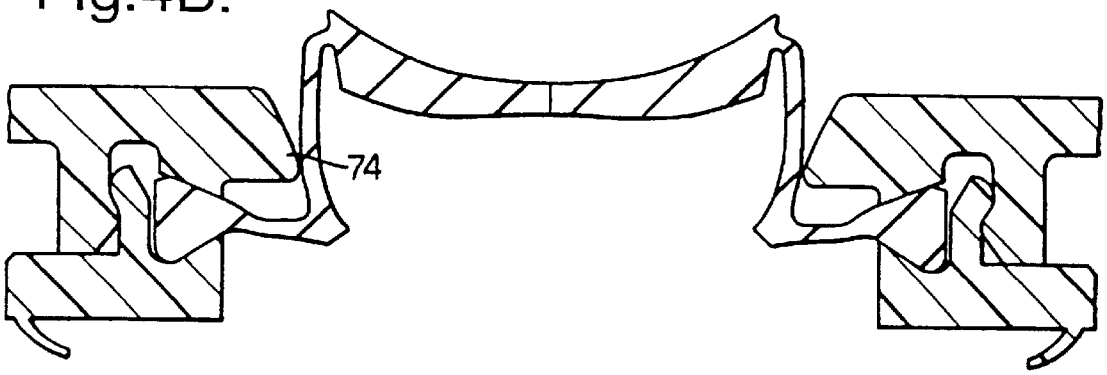
Figure 4C:
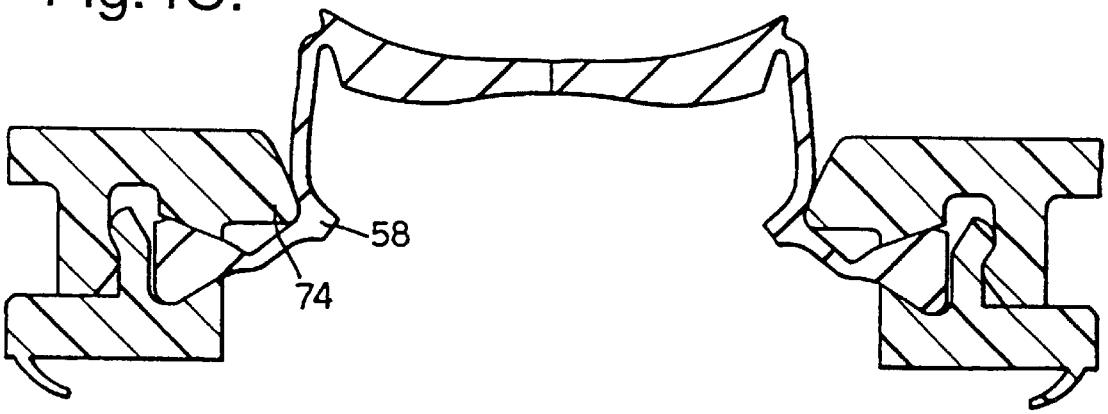

In the second embodiment, shown in FIG. 4, the valve 10 is exactly as has been described in relation to the first embodiment and accordingly it is not described again. The housing 12, however, is modified by radially inward extension of its upper part 32 to provide an annular nose 74. As the connecting wall 24 moves generally upwardly and outwardly during its movement for product dispensing, its elbow 58 comes into nesting engagement with this nose of the housing so as to define the vertical position which the head adopts for dispensing—See FIG. 4C. In contrast, in the first embodiment the connecting wall does not engage the housing, and the position of the head for dispensing is determined entirely by the dynamic balance of the forces in the connecting wall and the valve head.

Of the various parts of FIG. 4, FIGS. 4A, 4B and 4C show stages of operation of the valve corresponding to those represented in FIGS. 2A, 2B and 2C respectively. The stages of operation corresponding to those of FIGS. 2D to 2E likewise correspond, but they are not shown.

FIG. 5 shows a third embodiment of the invention to be similar to that of FIG. 4 in that the dispensing position of the valve head 22 is likewise determined by engagement of the connecting wall 24 with the upper part 32 of the housing 12. In this embodiment the engagement is made between the upper surface 62 of the outer wall part 56 and the complementary undersurface 75 of an annular nose 76 formed on the upper part 32 of the housing.

Figure 5A:
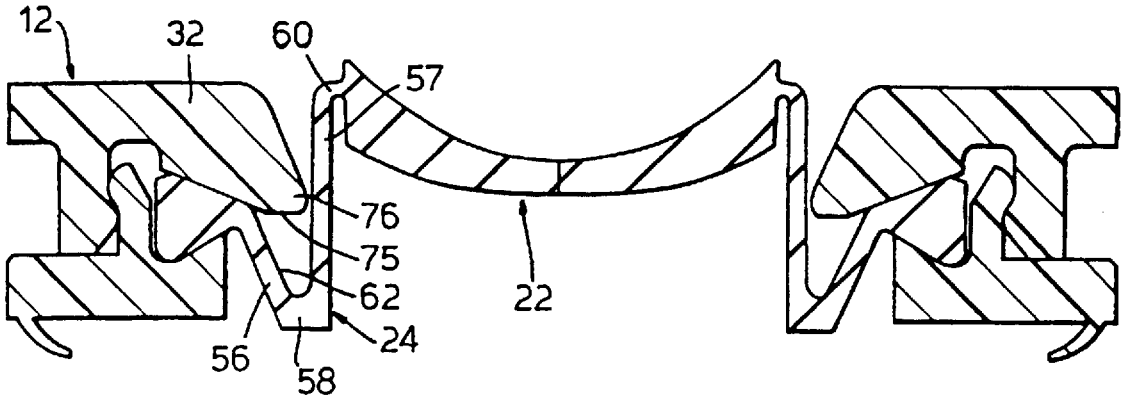
FIGS. 5A through 5C correspondingly show a third valve in accordance with the invention, in views similar to some of those of FIG. 2.
Figure 5B:
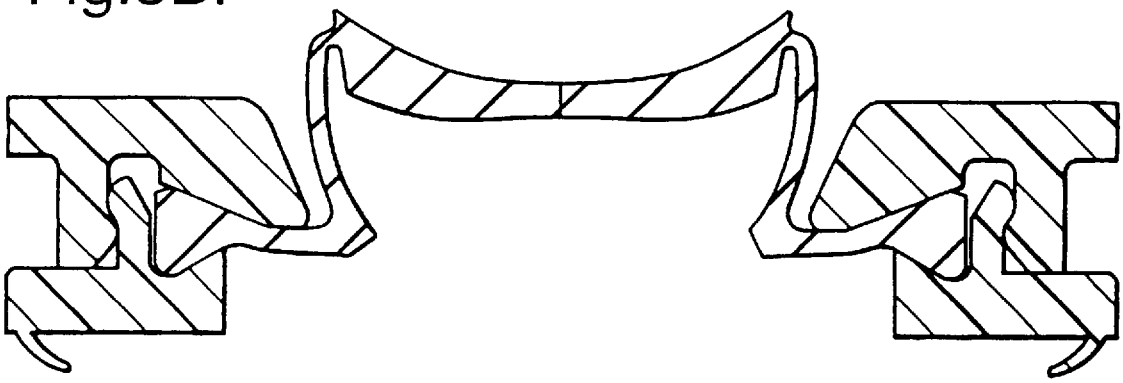
Figure 5C:
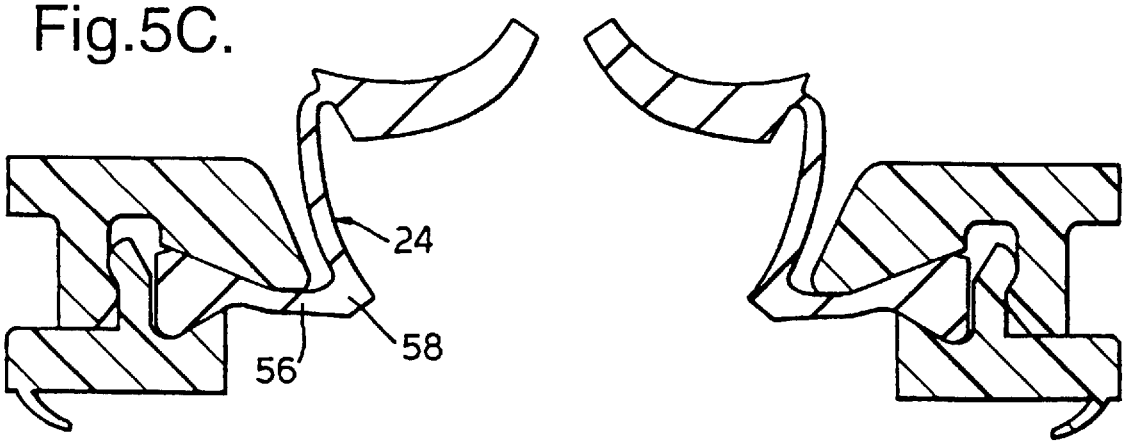

In FIG. 5 its engagement with the housing 12 restricts the upward movement of the outer part 56 of the connecting wall 24 to the substantially horizontal and plane position shown in FIGS. 5B and 5C. This will be seen to correspond approximately to the unstable position represented in FIGS. 2B and 4B for the earlier embodiments. By reverting to its unstressed, low energy condition the outer wall part 56 therefore assists the elbow 58 to return the valve resiliently to its retracted position after dispensing.

From FIG. 5A in particular it will be seen that the outer and inner parts 56, 57 of the connecting wall 24 are made longer than in the earlier embodiments, being correspondingly inclined to one another by a smaller acute angle of approximately 30° at the elbow 58. This increased length of the parts of the connecting wall compensates in part for the restricted movement which is available, caused by the engagement by the nose 76 as described.

In the various parts of FIG. 5, FIGS. 5A, 5B and 5C can be considered to show the stages of operation which correspond to those of FIGS. 2A, 2B and 2E of the first embodiment.

In the embodiments of the invention described above the valve heads 22 and their attachments to the connecting wall 24 by the connecting valve 60 are identical, and because of the isolating function of the connecting flange the valve heads operate in a substantially identical manner.

In all the embodiments described above, the periphery of the valve head 22 stands proud of the adjacent surrounding part of the housing 12 at all times, in particular in the "at rest" position of the valve. Together with the shape of the compliant portion 59 which forms the valve periphery, this proudness helps promote clean operation of the valve during dispensing, with little or no dripping when the container has been inverted again after dispensing in a valve-down position. In this respect it should be noted that the invention may have application to containers which are normally in a valve-down position, such for example, as liquid soap dispensers intended to be mounted in an inverted position on a wall, as well as to containers which require to be inverted for use.

Although a preferred embodiment of the invention has been specifically illustrated and described herein, it is to be understood that minor variations may be made in the apparatus without departing from the spirit and scope of the invention, as defined the appended claims.

What is claimed is:

1. A self-closing valve for a packaging container, which comprises (a) a marginal region (20) by which the valve (10) is peripherally secured to a housing (12) so as to close an opening (13) in the same, (b) a valve head (22) having an openable dispensing aperture (70) and movable axially in relation to the marginal region between an advanced, dispensing position in which the aperture is open and product is dispensed under pressure and a retracted, inoperative position in which the aperture is closed and the valve head forms a seal, and (c) a connecting wall (24) which is imperforate and flexible, characterized in that the connecting wall (24) comprises first and second portions (56, 57) serially arranged between the marginal region (20) and the valve head (22) and joined together at a V-form elbow (58), the first portion (56) extending inwardly from the marginal region to the elbow, the second portion (57) extending generally axially from the elbow to peripheral attachment with the valve head, and the connecting wall being of increased wall thickness at the elbow whereby during operation of the valve the elbow may keep its identity and act resiliently as a spring for returning the valve head to its retracted position.

2. A valve in accordance with claim 1, characterized in that the first portion (56) of the connecting wall (24) is substantially frustoconical when the valve head (22) is in each of its retracted and advanced positions, said first portion (56) extending inwardly and downwardly away from the valve head in its retracted position, and said first portion (56) extending inwardly and upwardly towards the valve head in its advanced position, the valve operating bistably between its retracted and advanced positions at a positive pressure.

3. A valve in accordance with claim 1, characterized in that the first portion (56) of the connecting wall (24) is arranged to move from a substantially frustoconical, inwardly and downwardly extending unstressed position to a substantially plane, metastable position as the valve head (22) moves between its retracted and advanced positions.

4. A valve in accordance with claim 1, characterized in that the connecting wall (24) has an inturned, substantially radially extending flange (60) by which it is attached to a valve head periphery (40), the thickness of the valve head (22) reducing from the valve head periphery inwardly towards the dispensing aperture (70), and the flange of the connecting wall having a thickness which is at most one third of the thickness of the valve head periphery and such that during operation of the valve the valve acts as a living hinge, with substantially no flexural stiffness.

5. A valve according to claim 1, characterized in that an at-rest position of the valve (10) in use is the same as the position in which it is manufactured.

6. A valve according to claim 1, characterized by means (54, 54A) for inwardly projecting from the connecting wall (24) adjacent the elbow (58).

7. A valve in accordance with claim 6, characterized in that the means for inwardly projecting comprises a ring of spaced bosses (54).

8. A valve in accordance with claim 6, characterized in that the means for inwardly projecting comprises a continuous bead (54A).

9. A valve in accordance with claim 1, in combination with the housing (12) by which the valve (10) is mounted in sealing relation at its marginal region (20).

10. A combination in accordance with claim 9, characterized in that at all times during movement of the valve (10) between its retracted and advanced positions, its connecting wall (24) and head (22) are spaced from the housing (12).

11. A combination in accordance with claim 9 characterized in that as the valve (10) moves from its retracted to its advanced positions the elbow (58) of the connecting wall (24) comes into restraining engagement with the housing (12).

12. A combination in accordance with claim 9 characterized in that as the valve (10) moves from its retracted to its advanced positions the first portion (56) of the connecting wall (24) comes into restraining engagement with the housing (12).

13. A combination in accordance with claim 9, characterized in that around an upper periphery the valve head (22) has a compliant and tapering lip (59) which stands proud of the housing (12) at all times during operation of the valve.

* * * * *